US006691441B1

(12) United States Patent
Crivelli et al.

(10) Patent No.: US 6,691,441 B1
(45) Date of Patent: Feb. 17, 2004

(54) DEVICE FOR INDIVIDUALLY AND SELECTIVELY DISPLAYING A SET OF POSTERS

(75) Inventors: Alain Crivelli, Brest (FR); Remy Kerouanton, Kerouezee (FR); Yann Kerouanton, Le Conquet (FR)

(73) Assignee: Mobil'Affiche International, Brest (FR)

( * ) Notice: Subject to any disclaimer, the term of this patent is extended or adjusted under 35 U.S.C. 154(b) by 554 days.

(21) Appl. No.: 09/336,648

(22) Filed: Jun. 18, 1999

Related U.S. Application Data

(63) Continuation-in-part of application No. 08/776,286, filed on Mar. 31, 1997, now abandoned.

(51) Int. Cl.[7] ..... G09F 11/18

(52) U.S. Cl. ..... 40/471; 40/467; 40/515; 40/518

(58) Field of Search ..... 40/467, 471, 514, 40/515, 518, 522, 524

(56) References Cited

U.S. PATENT DOCUMENTS

| | | | | | |
|---|---|---|---|---|---|
| 889,814 | A | * | 6/1908 | Sawyer | 40/515 X |
| 1,149,317 | A | * | 8/1915 | Ahlstrom | 40/518 X |
| 1,706,550 | A | * | 3/1929 | Stader | 40/471 X |
| 1,749,784 | A | * | 3/1930 | Slotsky | 40/471 |
| 3,426,461 | A | * | 2/1969 | Miller | 40/471 |
| 3,616,554 | A | * | 11/1971 | Singer et al. | 40/471 |
| 4,176,483 | A | * | 12/1979 | Bailey | 40/467 |
| 4,680,883 | A | * | 7/1987 | Stadjuhar et al. | 40/471 |
| 4,965,947 | A | * | 10/1990 | Zanetti | 40/518 X |
| 5,003,717 | A | * | 4/1991 | Trame et al. | 40/471 X |
| 5,410,330 | A | * | 4/1995 | Simson et al. | 345/110 |
| 5,597,994 | A | * | 1/1997 | Hornung | 40/471 X |
| 5,598,651 | A | * | 2/1997 | Aiken et al. | 40/518 |
| 5,809,677 | A | * | 9/1998 | Wamser et al. | 40/471 |
| 5,953,840 | A | * | 9/1999 | Simson et al. | 40/471 |

FOREIGN PATENT DOCUMENTS

| | | | | |
|---|---|---|---|---|
| FR | 1328806 | * | 4/1963 | 40/518 |
| GB | 16830 | * | 11/1907 | 40/518 |
| GB | 25271 | * | 7/1910 | 40/515 |
| GB | 2131215 | * | 6/1984 | 40/471 |

* cited by examiner

*Primary Examiner*—Andrea Chop
(74) *Attorney, Agent, or Firm*—Blakely, Sokoloff, Taylor & Zafman

(57) ABSTRACT

A device for displaying a set of various flexible posters is described. The device includes a set of receiver drums on which the posters are respectively at least partially wound, a display window and a positioning mechanism for positioning each poster of the set in one of a stowed position in which the poster cannot be seen through the display window and an operative position in which the poster is aligned with the display window. The posters which are in the operative position lie in spaced apart parallel planes. The positioning mechanism comprises a set of motors, each motor of the set being associated with a respective one of the receiver drum, and a programmable control assembly able to send independent control signals to the motors so that any display order is achievable through programming the control assembly.

16 Claims, 7 Drawing Sheets

DEVICE FOR INDIVIDUALLY AND SELECTIVELY DISPLAYING A SET OF POSTERS

This application is a continuation-in-part of application Ser. No. 08/776,286, filed Mar. 31, 1997, now abandoned.

BACKGROUND

1. Field of the Invention

The present invention concerns a system for selective, individual display of posters from a set of posters by successively positioning them behind a display window.

2. Description of the Related Art

Applications for this system notably include the advertising field, or that of road signs and information.

It can be used in a stationary fixture, for changing message (or other views) billboards.

It can also be used on board vehicles, in which case the display windows for advertising messages are provided on the sides and/or rear of a van-type vehicle.

In this type of system, posters are generally put end to end on a flexible support in order to constitute a single long strip.

It can be an endless strip, as provided for in documents FR A 1 051 852, FR-A-2 579 810 and U.S. Pat. No. 1,530,888, for example.

According to other possible implementations, such as those described in FR-A-2 692 395, FR-A-2 152 012 and W0/9203813, a relatively short strip is provided, wound on drums at each end.

The long strip scrolls down in front of the display window. Strip position is controlled and driven so as to bring the selected poster immediately behind the display window, thereby making it visible to viewers, i.e., the public in the case of advertising.

In the first four documents mentioned above, the display system is fitted on an advertising vehicle.

The display sequence control can be easily piloted by a programmable controller or a computer. Appropriate control means such as opto-electronic detectors cells and/or mechanical detectors connected to the system ensure its correct operation.

In existing devices, the posters are in single file, in a pre-determined order, meaning that they will be displayed in that order through the display window.

This raises a problem when the display sequence does not correspond to that order.

Therefore, if two non-neighbouring posters are to be displayed successively, the one or those between them must be scrolled as blank views behind the viewing window. This creates unsatisfactory viewing conditions when the posters are in motion. Moreover, the blank displays take up part of the total viewing time.

In this respect, it should be noted that an advertising contract between an advertising contractor and the client, can specify varying display cycles for the different posters. Thus each poster can be assigned a frequency and display time, which can be modified over time.

The order in which given posters pass can also be determined, especially when the ideas of two or more posters are linked, as in the case of "progressive" advertising campaigns.

These successive display requirements are difficult to accommodate with a set of posters secured end-to-end, as in the current state of the art.

Document FR-A-388 854, titled luminous advertising equipment, corresponds to a display device containing a set of screens (bearing advertisements) hanging in vertical, parallel planes which can be possibly and successively displayed in the same space. The posters are stowed by winding onto a roller located in the upper part of the device. The set of rollers is driven by a single drive shaft, via a motion transmitting mechanism ensuring that while one screen is being wound, the next screen begins to descend, and so on for the entire set, in a determined order.

Thus in the existing device the various advertisements are shown in an unchanging, predetermined order.

SUMMARY

The invention aims at resolving this difficulty by proposing a displaying device of the type mentioned above, in which display of a selected poster can be freely chosen, not only in terms of frequency and duration, but also for the order in which it will be displayed.

The equipment covered in the present invention provides an individually selectively displaying of various posters of a set, by positioning them successively in front of a display window.

As in device described in document FR A-388 854, each of the posters is secured to a flexible backing at least partially windable onto a rotary receiving drum, a control assembly being provided for selectively positioning said poster in a stowed position in which it cannot be seen through the display window, and in an operative position in which it is aligned with said window, and the various posters lie in separate slightly spaced apart parallel planes.

The above objectives are achieved, according to the invention, with a device comprising a set of various flexible posters and a set of rotary drums on which the posters are respectively at least partially wounded, a display window and means for positioning each poster of the set in one of a stowed position in which it cannot be seen through the display window and an operative position in which it is aligned with said window and in which the posters which are in the operative position lie in slightly spaced apart parallel planes, the positioning means comprising a set of motors each associated with a respective receiver drum, and comprising a programmable control assembly able to send independent control signals to the motors so that any display order can be achieved through programming the control assembly Of course, the device is designed so that when a poster is in a stowed position, neither the elements making up its support, nor the poster itself will hamper the display of other posters in operation.

Moreover, according to a number or additional, advantageous, non-restrictive features of the invention:

- the flexible support includes a flexible strip wound around the receiver drum and extended at display window height, by a pair of lateral straps;
- the two straps are connected by a crossbar used to secure the poster;
- the poster is attached both to this crossbar, remaining removable and to the transversal edge of the flexible strip;
- the device contains means of tensioning the flexible strip;
- the bar is attached to a pair of stretcher cables wound onto automatic return pulleys;
- at the exit of the receiver drum, the flexible strip passes over a countershaft roller;

this countershaft roller is tapered at both ends, with its diameter slightly larger in its middle, so that the strip is kept well-centered;

the display window is vertical, while the horizontal axes of the drums and the countershaft roller, as applicable, are set parallel to the window's main plane, located in a box at the top of the window; in this case, the return pulleys have advantageously a horizontal axis and are located in a box at a bottom of the window.

The invention also covers advertising vehicle equipped with at least one such device, as defined above.

BRIEF DESCRIPTION OF THE DRAWINGS

Other features and advantages of the invention will be clear from the attached description and drawings showing a preferable implementation.

On the drawings.

DETAILED DESCRIPTION

Figure 1:
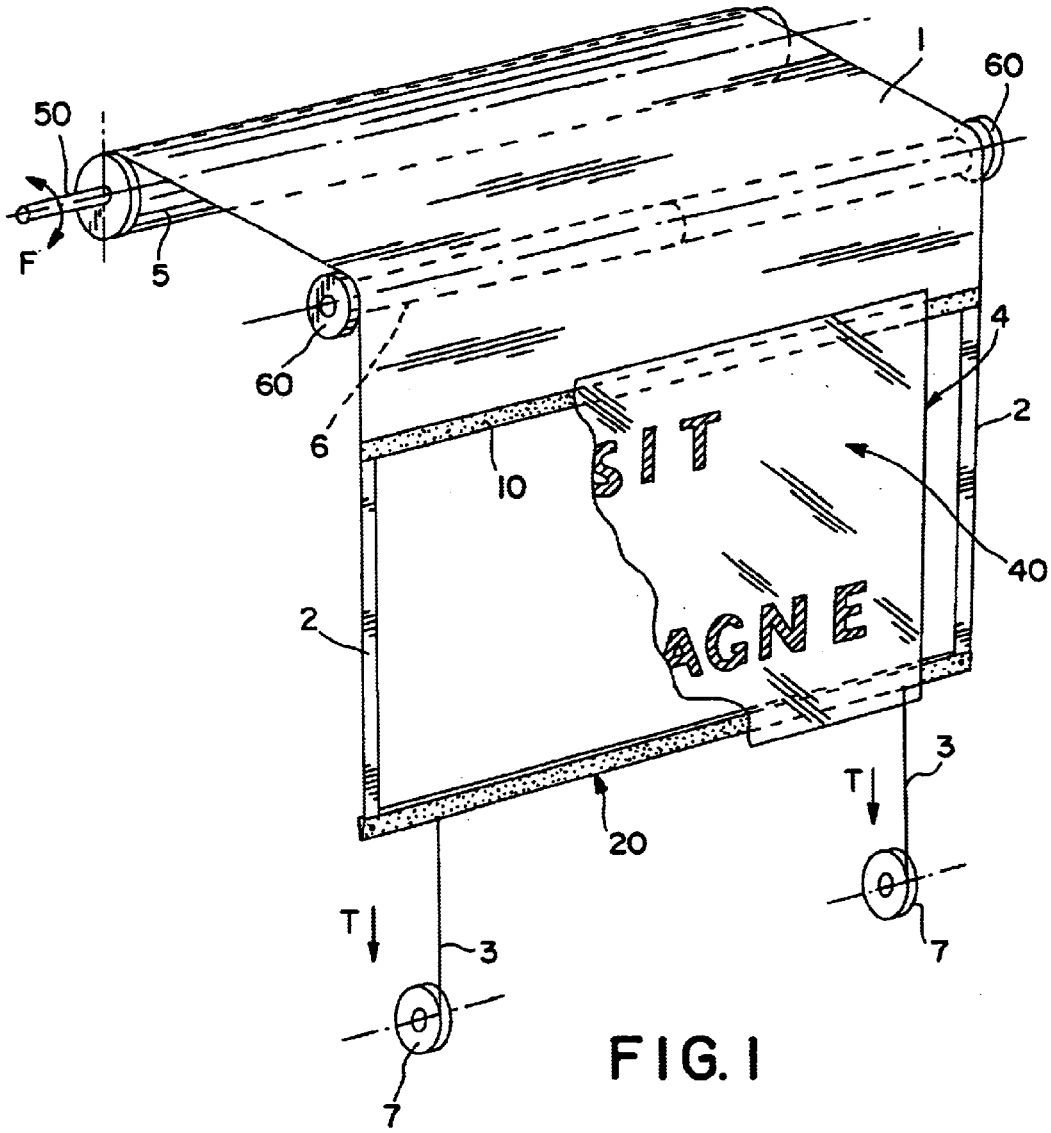
FIG. 1 is a perspective diagram of the flexible support receiving a poster (represented partially pulled out) as well as guide and drive means, the poster being in displayed position facing the viewing window (not shown)

In the implementation presented hereinafter, shown in the drawings, the display window has a vertical layout and the device contains a set of five posters which can be selectively positioned in turn behind this window.

Obviously, the choice of five is simply taken as an example, and there could be any number of posters.

FIG. 1 shows the flexible support receiving one of the posters.

This support is made up of a flexible strip 1, such as thin oilcloth, a pair of lateral straps 2 and a pair of lateral cables 3.

The strip 1 forming the top of the support, is wound around a rotating cylindrical drum 5, whose axis 50 is horizontal. The latter is parallel to the display window's general vertical plane, not shown here.

Driving means, described below, can turn the drum 5 in one or another direction, as indicated by the double arrow F in FIG. 1.

Figure 4:
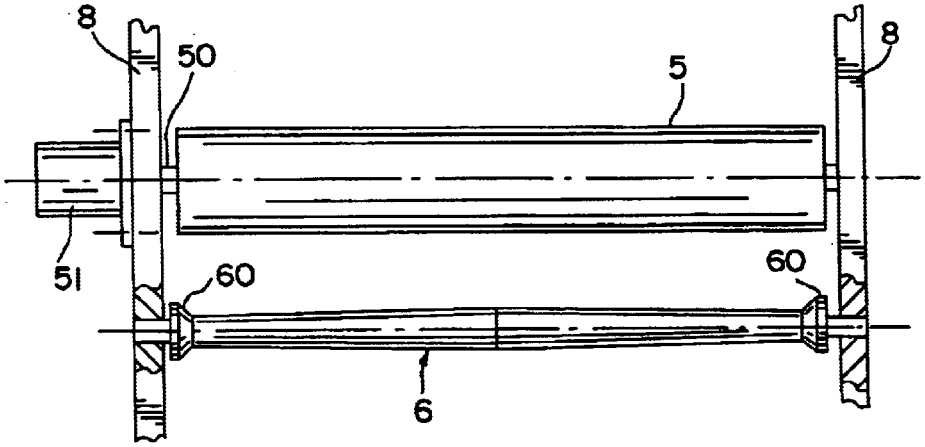
FIG. 4 is a top view of a receiver drum and its associated guide roller.

The strip 1 passes over a countershaft roller 6, whose horizontal axis is parallel to that of the drum 5. The counter-motion occurs at approximately 45° and the part of the strip linking the roller 6 to the drum is approximately horizontal. The roller 6 has a slightly tapered shape of low conicity, with its largest diameter at the middle, as shown more accurately in FIG. 4.

At its ends, which correspond to the little diameters of tapered shape, guide plates 60 are provided as stops for the side edges of the strip. These plates 60 are also tapered toward the inside, to prevent the strip from slipping out sideways. The slightly tapered shape of the roller 6 ensures automatic alignment, and good centering of the strip 1, both when unrolled and rolled up.

The tip of the strip 1 is extended from the side not wound round the drum 5 by lateral straps 2, which are made of non-stretch fabric. The straps 2 can be attached to the strip 1 by any appropriate means, such as gluing or riveting. The free tips of the straps 2 are connected by a crossbar 20.

Figure 2:
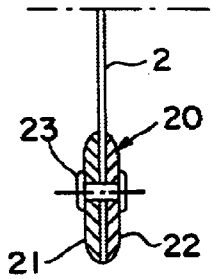
FIG. 2 shows a detail of the crossbar used to secure the poster, shown in cross-section.

As seen in FIG. 2, the bar 20 is made up of a set of two small, thin plates 21, 22, with rounded edges, between which the two straps 2 are inserted and which secured by rivets 23 which go through elements 21 and 22 and the strap 2.

The cables 3 are linked to the crossbar 20, then run downwards to each pulley 7 where each cable is wound. These pulleys each have two lateral discoid guide plates which form a groove for the cable (see FIG. 7).

The pulleys 7 are standard automatic return pulleys containing an internal coiled spring tending to constantly turn in the same direction as the cable winds in the groove, thus exerting traction on the cable, as shown by arrows T in FIG. 1.

In another embodiment of the invention, the pulleys 3 are suppressed and the bar 20 is chosen heavy enough to produce sufficient tensioning of the strip. In that case illustrated on FIG. 12, the bars extend laterally beyond the poster and the strip 1. Each extremity of any bar is guided in vertical sliding by a respective vertical guide 110, 120. For five posters, there are then ten vertical sliding guides.

The support assembly illustrated on FIG. 1 holds a poster 4 which can be easily removed.

In the implementation illustrated here, widely distributed "Velcro" (registered trademark) looped and burred fabric fastener is used to secure the poster.

To this end, the transversal edge of the flexible strip's 1 tip referenced as 10, and the crossbar 20 are, on the side facing the display window, attached to one of the two fabric fastener elements, for instance the burred fabric.

The posters 4 are then backed with the other fabric fastener element in corresponding locations—for instance the looped fabric—.

Thus, the poster is easily affixed to the support by simple pressing the strips together. Once secured, the poster fills the space corresponding to the rectangle formed by the two straps 2, the strip edge 10 and the crossbar 20.

The printing 40 on the posters is centered so as to appear properly through the display window (not shown in FIG. 1), whose dimensions are slightly smaller than those of the poster.

Figure 3:
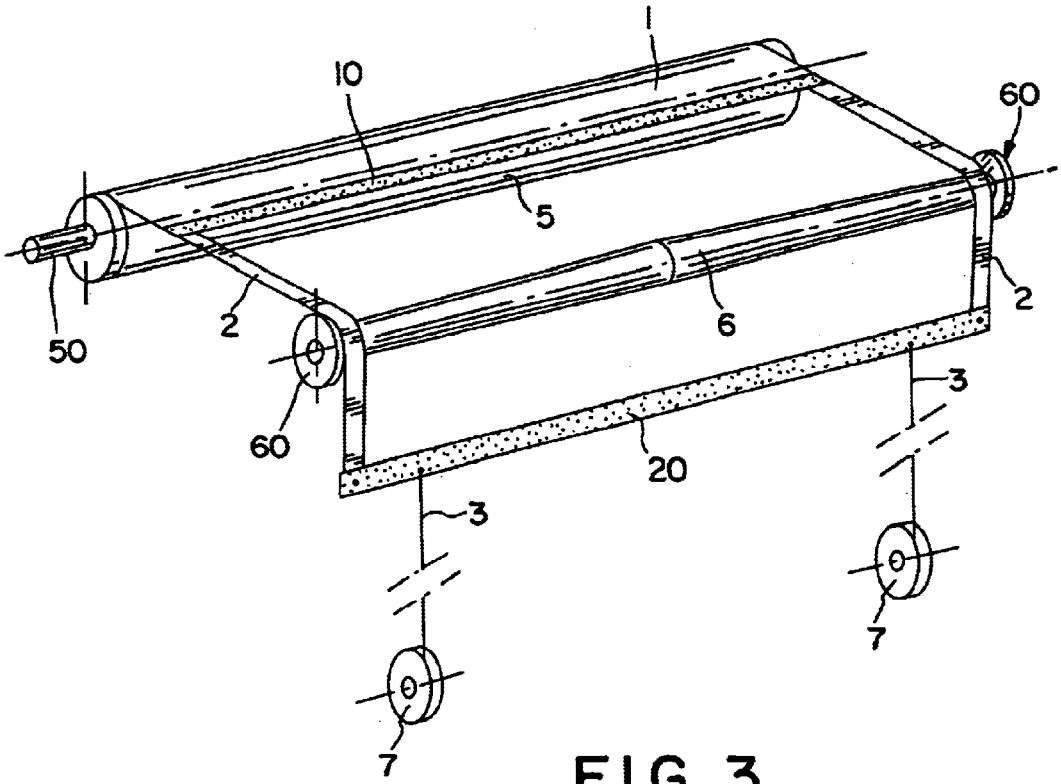
FIG. 3 is a similar view to that of FIG. 1, corresponding to the stowed position, poster assumed to be removed.

By simple comparing FIGS. 1 and 3, it can be seen that if the drum 5 10 turns in the same direction as the strip unrolls, the poster will displayed in the vertical plane; the poster is stretched out during deployment, as a result of the cable 3 traction exerted by the return pulleys 7 or as a result of the weight of bar 20.

If the drum 5 is rotated in the opposite direction, the strip 1 will wind almost completely around the drum, as the bar 20 moves into its upper position, above the display window's level. The poster is in stowed position, folded back on the countershaft roller 6. It can be seen that in the upper position, the straps 2 are retained laterally by the guide plates 60 of roller 6.

Figure 5:
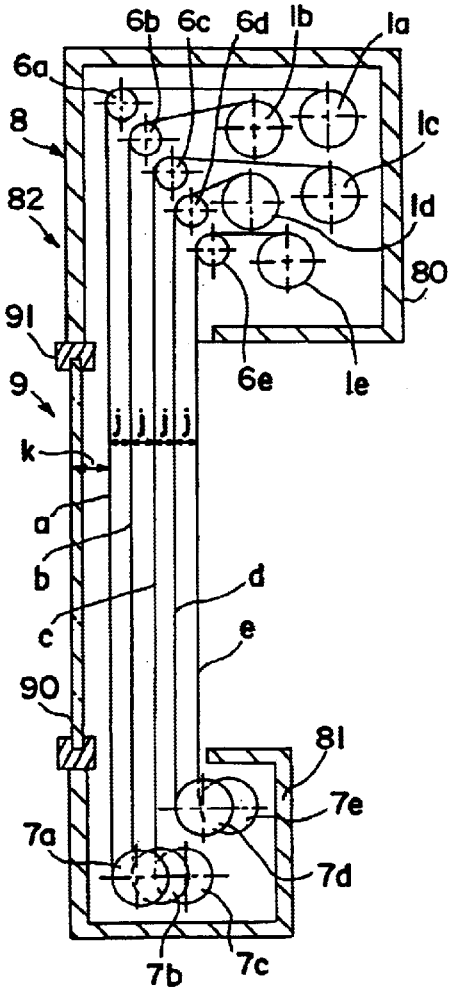
FIG. 5 shows a diagram of the entire device in a vertical cross-sectional view, perpendicular to the posters and the viewing window.

FIG. 5 shows how a set of five poster supports are set up in a device such as that just described.

In this figure, reference 9 designates the display window, including its frame 91 and a transparent panel 90, for example a pane of glass.

The device includes a chassis 8, essentially containing a front panel 82 holding the display window 9, an upper box 80 and a lower box 81.

In the top box 80 are contained the assembled set of drums 5 and guide rollers 6. In the bottom box 81 are contained the set of return pulleys 7.

These various elements are positioned so that each of the five flexible supports, has an operative position in one of the vertical planes a, b, c, d, or e which are parallel to the pane of glass 90. These different planes are regularly spaced, separated by a small gap marked j. Likewise, the first poster's plane a (that closest to the window) is only a short distance k from the pane of glass 90.

The various countershaft rollers 6*a*, 6*b*, 6*c*, 6*d* and 6*e* and the various drums 1*a*, 1*b*, 1*c*, 1*d* and 1*e* inside the box 80 are located so as to take as little space as possible and avoid any contact between the poster supports or the posters themselves.

Similarly, the positions of the different pulleys 7*a*, 7*b*, 7*c*, 7*d* and 7*e* in the lower box 81 are offset to avoid interference from the different cables, with maximal compactness.

Figure 7:
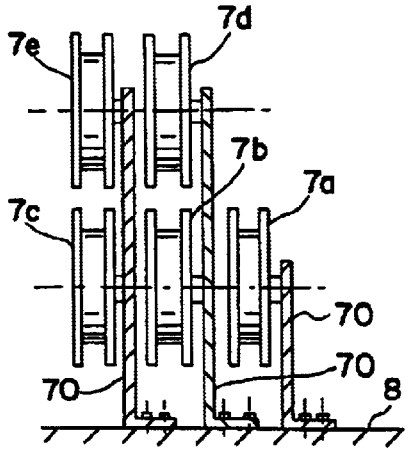
FIG. 7 is a side view of a set of return pulleys which ensure the traction of the stretcher cables located on one side of the device.

In the implementation shown here, particularly in FIGS. 5 and 7, the five pulleys provides on each side of the device are divided into two groups.

The axes of pulleys 7*a*, 7*b*, 7*c*, associated with the first three posters, are located in the same horizontal plane but are staggered both transversally and from front to back in order to ensure the spacing j mentioned above.

The other two pulleys 7*d* and 7*e* are arranged in the same way, at a higher lever than pulleys 7*a*, 7*b*, and 7*c*.

Each pulley is assembled idle on a T-bracket 70 fixed to the chassis 8.

The transversal staggering of the pulleys, is compensated by the fact that the cables 3 have different latching points on the crossbar 20.

Figure 8:
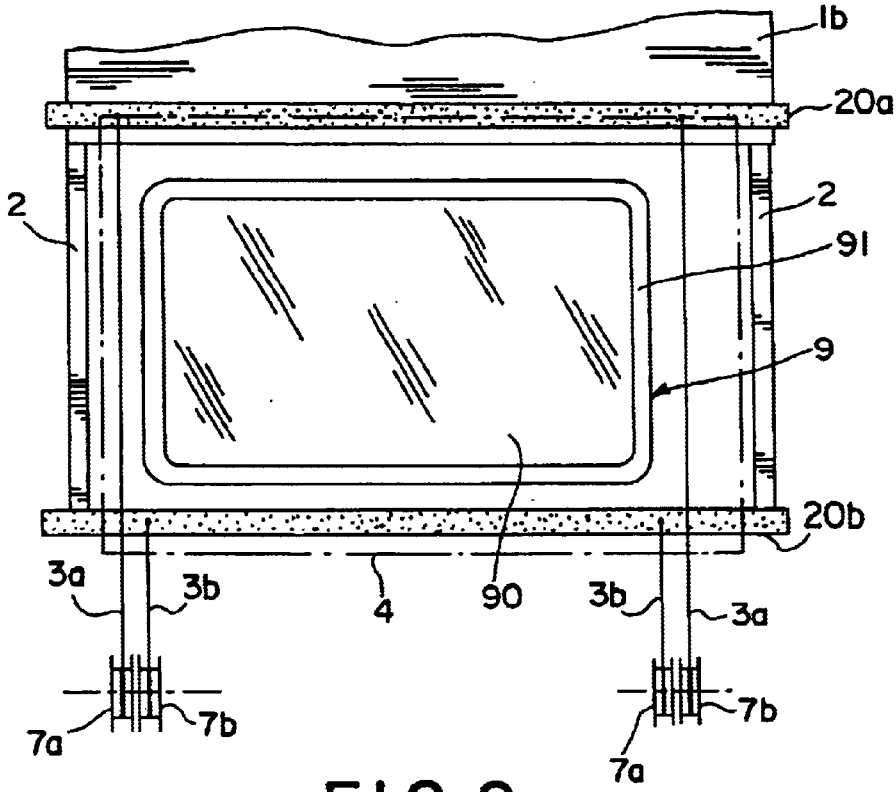
FIG. 8 is a smaller scale, side view of the lower part of FIG. 6.

This particularly stands out clearly in FIG. 8, showing that respective spacing of cables 3*a* is greater than that of cables 3*b*.

Each drum 5 is driven by an electric gear motor 51 fixed to the chassis 8, whose output shaft provides coaxial drive for the drum shaft 50.

Figure 13:
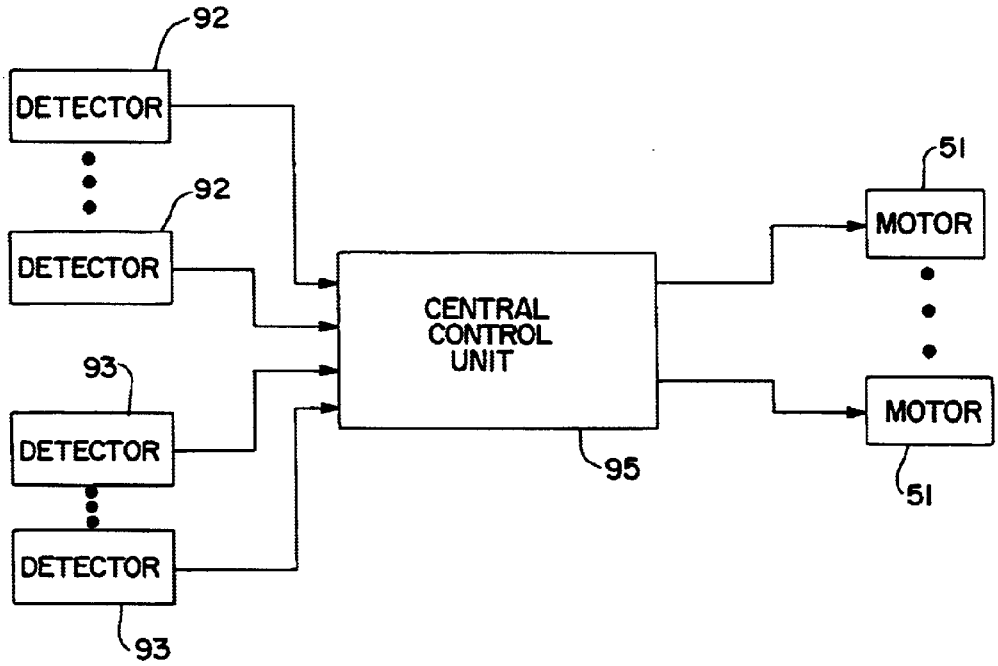
FIG. 13 is a block diagram showing the central control unit and its inputs and outputs.

All five motors driving drums 5*a* to 5*b* are piloted by a programmable controller or commuter 95 (see FIG. 13), containing the data relative to the desired display cycle, i.e., the order of scrolling and viewing and the frequency and display time for each poster.

Of course, some posters will be of displayed longer and/or more frequently than others, depending on the program.

Figure 6:
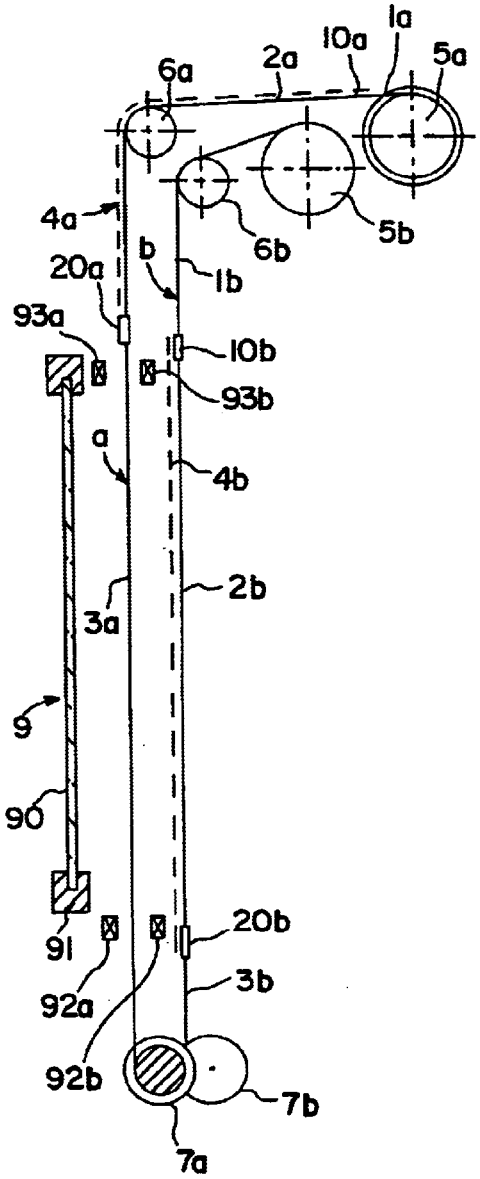
FIG. 6 is an enlarged view of that seen in FIG. 5, showing only two supports for neighbouring posters, one of which is in stowed position, the other in displayed position.

In the FIG. 6, only those systems related to the first two posters, corresponding to references a and b, are shown.

The first poster 4*a* is in stowed position, the strip 1*a* being wound onto its receiving drum 5*a*, and the poster in its upper position, not visible through the pane of glass 90 to a viewer situated on the left of the figure.

On the contrary, the poster 4*b* is in operative position, facing the pane of glass 90. Therefore, it is visible to the viewer.

The window 9 size ensures that the various control system parts, e.g., the straps, cables and crossbars of the system currently not in operation cannot be seen through the window.

In FIG. 8, it can be noted that the size of the poster 4, contoured here by lines and dashes, is much larger than that of the window.

FIG. 6 shows a diagram of detectors 92, 93 for the correct deployment or respective stowage for each poster.

The detectors 92*a*, 92*b* are located in the lower part of the window and detectors 93*a*, 93*b* in the upper part.

These are standard detectors e.g., opto-electronic types or photo-electric cells.

The deployment status of each poster can be controlled at all times by these detectors, which transmit the appropriate signals to the micro-processor or the electronic programmable controlled 95 piloting the motor, thus ensuring correct display operation.

As mentioned above, the posters and their supports are constantly stretched flat thanks to the return pulleys acting on the stretcher cables.

Figure 12:
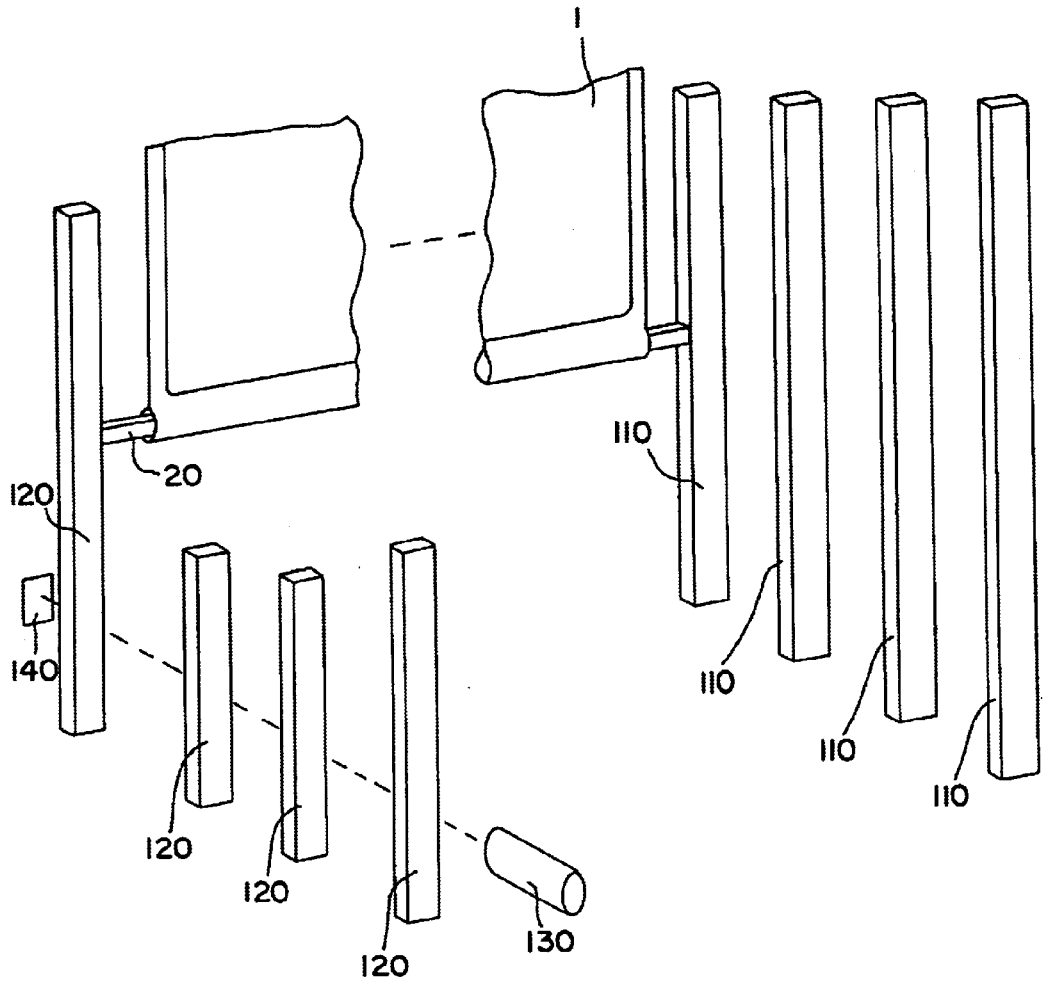
FIG. 12 is a partial perspective view of a device corresponding to another realisation mode of the invention.

In the other implementation of FIG. 12, the posters and supports could be stretched tight by simply adjusting the weight of the crossbar 20, with additional weights if required.

On this figure, an optical detector 130 and its reflector 140 are placed near the lower part of the sliding channel 120, so that a detecting bundle of the detector be interrupted by the extremity of the moving bar of any poster which changes position and not by the poster itself.

An upper detector is equally placed so that its detecting bundle or detecting field crosses the path of each bar and is out of the path of any poster, near the upper extremities of any sliding guide.

When the bundle of the upper detector is interrupted by a mounting or descending bar 20, it indicates to a central control unit that the bar 20 is passing in front of it. The central unit compares this data to the state of the considered poster, i.e. mounting or descending state and stops the movement of the corresponding poster if it is in mounting state. Central unit respects a delay between detection and stop phase, which lets the bar cross completely the detecting bundle, so that the detector 130 and the reflector 140 are anew available to detect the passage before it of any bar of the set of posters.

In the case of the lower detector, a delay is also adopted between the detection and the stopping of a descending poster so that the bundle doesn't remain interrupted by a stopped bar.

Central control unit 95 includes a central processing unit having in its memory a programmed display sequence realizes a permanent control of the positioning of each poster. For each programmed phase, for example a phase consisting in the replacement of poster A by poster C in front of the display window, the central unit awaits a signal from the lower captor indicating that the phase of lowering poster C is achieved. The central unit then starts the following phase in memory, which is raising poster A.

Central unit compares the phase on duty to the output signals of the different captors to detect the end of this phase. The central unit includes a memory which indicates at any moment the state of any of the posters.

Thus only one captor is necessary to identify the state of any of the posters. Only one captor detects passage of all the bars of the set.

In case of an error on the memorized current situation, due for example to a wrong detection of a captor, the control means are equipped with means which permit a user to erase the memory and to rewind all the posters. Such rewinding means are able to activate a simultaneous rewinding of all the lowered posters.

The central unit activates successive phases according to a sequence programmed by the user. For that purpose, the central unit is equipped with visualization means and a keyboard, for example a tactile screen.

The central unit offers the choice of the posters to be successively displayed. The user can choose any display order.

For each poster to display, the user chooses the display time. It is then possible to display some posters a long time, and on the contrary to display rapidly some others. Thus a client can choose the display time of his poster and the price of the service can be adapted to the client.

The programming means offer the possibility to program a plurality of different sequence, each sequence being for example a series of seven different display phases. It is then possible to adopt a different sequence as a function of the location of a van carrying the device, or as a function of the hour of the day. It is for example possible to display posters n°1, 2 and 4 early in the morning and posters 3, 5, and 7 late in the evening.

It is also possible to program a particular sequence of posters which may correspond to a story, as known under the name "teasing". In a particular realization mode, a front poster with windows through it can be kept in place while another poster is made moving behind the front poster, for example to simulate the movement of a slot-machine.

In that particular case, the back poster is programmed to make successive displacements between lower and upper position, and to stop in a position where a "7" is present in each of three windows of the front poster. The programming means include a pre-programmed sequence for this effect, so that the user has only to indicate the number of the front poster to program such a particular sequence.

The van equipped with such a displaying device is equipped with a special alternator specially dedicated to the feeding of the motors, control means, and enlightening means of the display device.

The van is equipped with a security system which activates a sound and a visual alarm and stops the previously mentioned electrical feeding when the motor of the vehicle is stopped. The displaying means are equipped with a connection allowing an external feeding. In this case the alarm means are inactivated.

In a preferred embodiment of the invention, the display device is mounted on a van with at least at display window forming a side wall of the van. The van contains, behind the place for displaying the posters, a large free space which can be also displayed when all the posters are wound in upper position. In this space can be shown any product to advertise which can be exposed during a time interval also programmed in the controlling device.

The device preferably includes also a non reset-able counter which indicates the total number of winding and unwinding for each motor independently, in order to share the future works taking into account the amount of work already demanded to the different motors.

One poster can quickly replace another because the stowage of the previous poster and the deployment of the new poster can be done simultaneously, in masked time.

The device lends itself remarkably well to progressive campaigns, where one poster's message elicits information to be discovered on one or several of the following posters.

The posters used, are made of thin, flexible material which resists ripping and wrinkling e.g., paper or plastic film.

Securing systems other than fabric fasteners can of course be used, e.g., clips, snaps or adhesive tape.

To facilitate the changing of posters, a display window which can be opened, or an easily removable pane of glass allowing access to various poster supports, should be provided.

Obviously, the device size will be adapted to the size of posters to be used.

As an indication, the width of the strip 1 will range from 1 to several meters, the drum 5 and countershaft roller 6 having adapted lengths.

The drums 5 could be made of aluminium, with a diameter of about 60 millimeters.

The rollers 6 should preferably be made of surface treated aluminium to avoid leaving marks on the back of the posters, and should be about 30 to 40 millimeters in diameter.

The spacing j between posters will be from about 15 to 30 millimeters.

The return pulleys 7 diameter will be from about 80 to 100 millimeters.

This kind of device can be used in stationary fixture, e.g., built into a building's façade, or housed in a panel mounted on any type of support.

Figure 9:
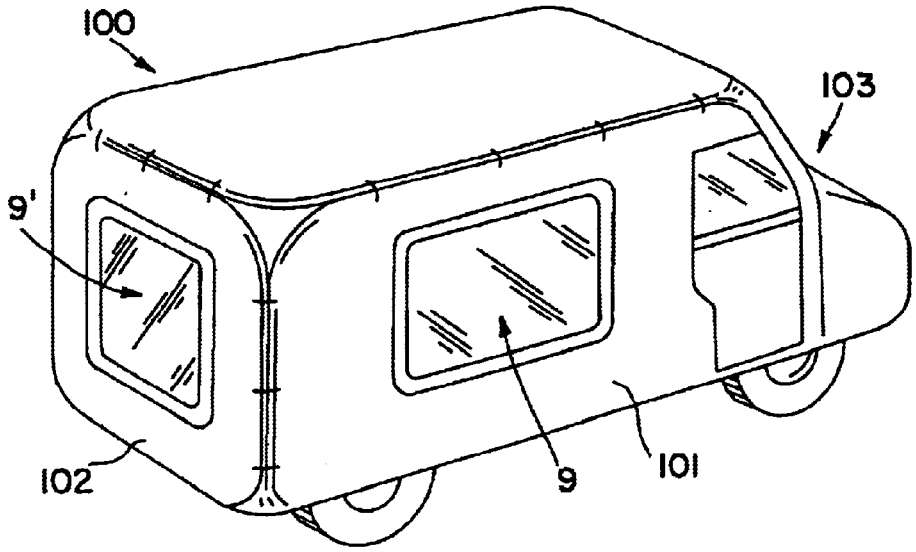
FIG. 9 shows a sketch of an advertising vehicle fitted with several devices from the invention.

It can be also assembled on an advertising vehicle, as illustrated in FIG. 9.

This figure shows a van-type vehicle 100 with driver's cab 103. The vehicle has side 101 and rear 102 panels, equipped with display windows 9 respectively 9', of posters. As provided for in the invention, there are three display devices inside the vehicle, each of them associated with one of the windows.

Figure 10:
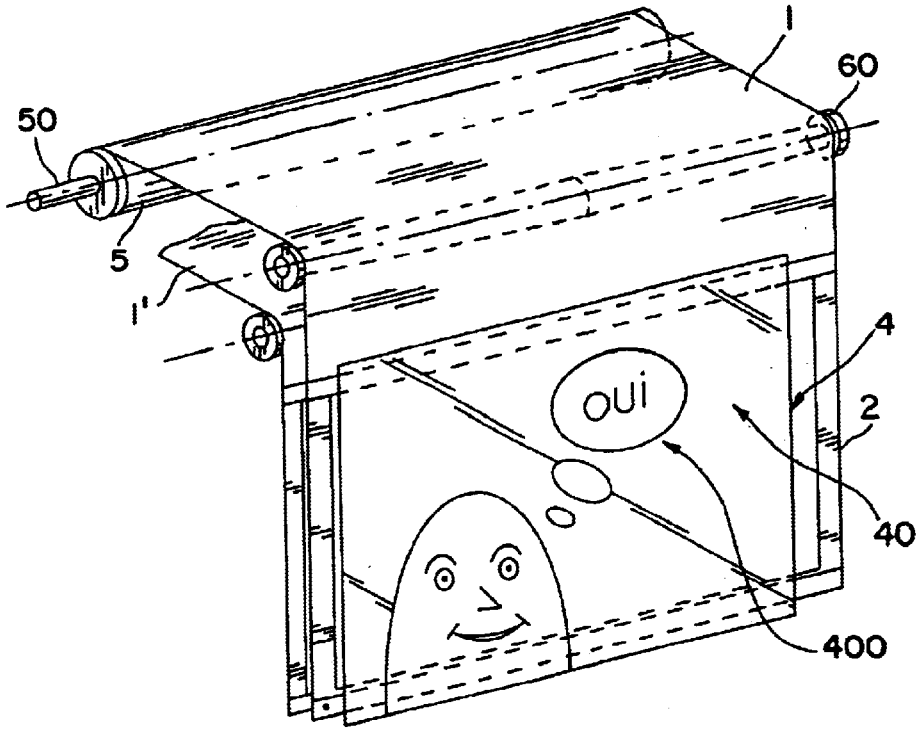
FIG. 10 is a similar view to FIG. 1, showing two supports of neighbouring posters, both posters are lowered and the front poster contains a framed opening.
Figure 11:
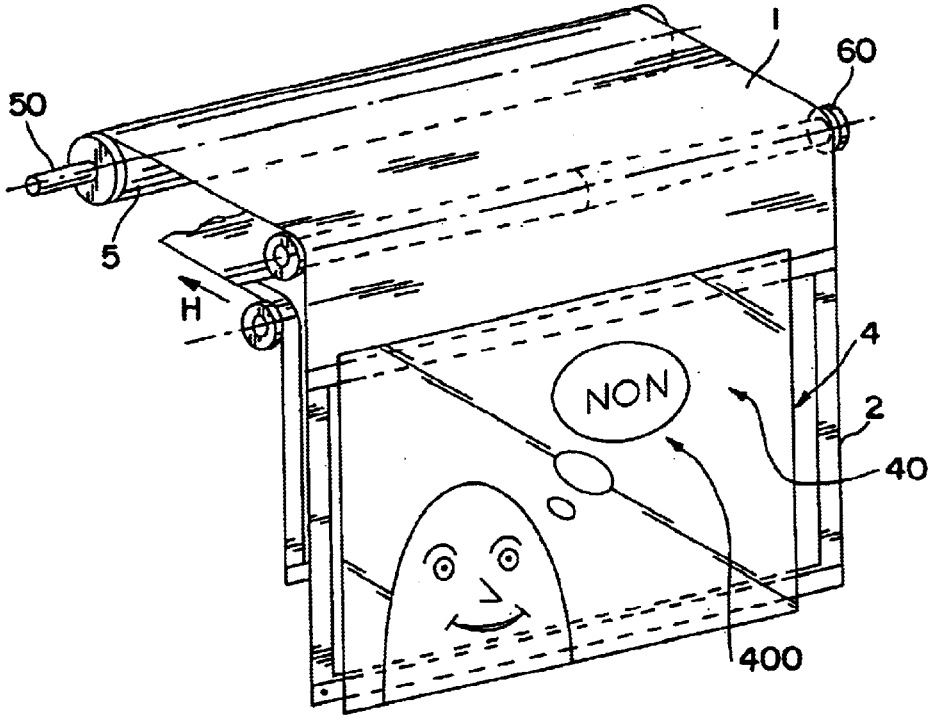
FIG. 11 is a similar view to FIG. 10, in which the rear poster is partially raised.

In the implementation illustrated in FIGS. 10 and 11, the poster 4 shows a frame 400 enabling the poster located behind it to be seen. This can be a simple opening across the poster, or a transparent area. Thus depending on how far the strip 1' bearing the poster to be placed behind the frame poster 4 is unwound, different parts of this poster will be seen through this window 400. Consequently, if drawings, messages, are printed on the rear poster, so that they selectively appear in the window 400, one can modify progressively the scene displayed as viewed on the front poster.

In the example given for FIGS. 10 and 11, the window is a "a speech balloon" expressing what an advertising character is thinking.

On the rear (hidden) poster there are two messages provided, i.e. "OUI" and "NON" placed at two different heights, and both suitable to appear in the speech balloon when the rear poster is lowered (FIG. 10) or partially raised (arrow H, FIG. 11).

Naturally, several windows could be provided on the former poster with two or more messages assigned to them on the rear poster. Moreover, messages can also be affixed on one (or more) poster(s) located well behind and becoming visible when the poster(s) between them is (are) raised completely.

In an other implementation of the device, a single plastic strip makes up both the poster and its flexible support. This one contains a blank leader area wound onto the receiver drum. The rest of the strip has the printing, drawings, or other messages to display. These can be applied to the strip as appropriate, e.g., being glued on or directly printed. A weighted bar attached to the free tip of the strip ensures its tensioning and its return to an operative position. The ends of the bar remain well guided in vertical runners on the sides.

What is claimed is:

1. A device comprising a set of various flexible posters and a set of receiver drums on which the posters are respectively at least partially wound, a display window and means for positioning each poster of the set in one of a wound position in which the poster cannot be seen through the display window and an operative position in which the poster is registered with said window and wherein the posters which are in the operative position lie in planes which are parallel, spaced apart and which substantially register with each other, the positioning means comprising a set of motors, each motor of the set being associated with a respective one of the receiver drums, and the positioning means comprising a programmable control assembly able to send independent control signals to the motors so that any display order is achievable through programming the control assembly.

2. The device according to claim 1, wherein each poster is attached to a respective flexible backing which forms a flexible strip wound on to one of the receiver drums and which extends in front of the display window by a pair of straps which are lateral to the poster.

3. The device according to claim 2, wherein the pair of lateral straps is linked by a cross bar attached to the poster.

4. The device according to claim 3, wherein said strip forms a transversal edge and wherein said poster is attached to said cross bar and said transversal edge in such a way that the poster is removable.

5. The device according to claim 3, wherein the cross bar is attached to a pair of stretcher cables automatically wound on to return pulleys.

6. The device according to claim 5, wherein said return pulleys have horizontal axes and are placed in a box in a lower part of the window.

7. The device according to claim 2, wherein said device includes means for tensioning the flexible strip.

8. The device according to claim 2, wherein the device includes a countershaft roller placed in vicinity to a receiver drum, and the strip wound on the receiver drum passes on said countershaft roller at an exit of said receiver drum.

9. The device according to claim 8, wherein the countershaft roller is tapered with a larger diameter at a middle part of said roller, in order to better center the strip.

10. The device according to claim 8, wherein the display window is arranged vertically, the device includes a box in an upper part of said display window, and the drums and the countershaft roller are placed in this box, and the drums and the countershaft roller are placed parallel to the display window.

11. Advertising vehicle equipped with at least one device according to claim 1.

12. The device according to claim 1, wherein each poster is equipped with a part which protrudes laterally from the poster, and wherein the device includes an optical sensor having a detection bundle, the optical sensor being located so that the detection bundle is crossed by the protruding part of any one of the posters when said any one of the posters is moved between said wound and said operative position.

13. The device according to claim 12, wherein the device includes means for transmitting a detecting signal to the control assembly when the detection bundle of the optical sensor is crossed, and wherein the control assembly includes means for stopping a moving poster when the control assembly receives a detecting signal and wherein the control assembly includes means for stopping the poster after a delay which is sufficient to allow the protruding part of the poster to pass beyond the bundle of the optical sensor.

14. A device comprising a set of various flexible posters and a set of receiver drums on which the posters are respectively at least partially wound, a display window and means for positioning each poster of the set in one of a wound position in which the poster cannot be seen through the display window and an operative position in which the poster is registered with said window and wherein the posters which are in the operative position lie in planes which are parallel, spaced apart and which substantially register with each other, the positioning means comprising a set of motors each associated with a respective one of the receiver drums and the positioning means comprising a programmable control assembly able to send independent control signals to the motors so that any display order of the posters is achievable through programming the control assembly, the control assembly also comprising means for programming a duration of exposure of each poster independently, in order to modulate the exposure time as a function of the poster.

15. A device comprising a set of various flexible posters and a set of receiver drums on which the posters are respectively at least partially wound, a display window and means for positioning each poster of the set in one of a wound position in which the poster cannot be seen through the display window and an operative position in which the poster is registered with said window and wherein the posters which are in the operative position lie in planes which are parallel, spaced apart and which substantially register with each other, the positioning means comprising a set of motors each associated with a respective receiver drum, the positioning means comprising also a programmable control assembly able to send independent control signals to the motors so that any display order of the posters is achievable through programming of the control assembly, the control assembly also including means for programming a plurality of different display sequences, each sequence corresponding to a respective specific succession of posters to be displayed.

16. A device comprising:

a set of receiver drums on which a set of flexible posters are at least partially wound;

a display window;

a positioning mechanism including a set of motors, each motor of the set being associated with a respective one of the receiver drums, the positioning mechanism comprising also a programmable control assembly to send independent control signals to the motors to position each poster of the set in one of (1) a wound position in which the poster cannot be seen through the display window and (2) an operative position in which the poster is registered with said window, wherein the posters which are in the operative position lie in planes which are parallel, spaced apart, and which substantially register with each other; and wherein said positioning mechanism enables each poster of the set to move independently with respect to the other posters so that any display order is achievable through programming of the programmable control assembly.

* * * * *